US006442965B1

(12) United States Patent
Paesante

(10) Patent No.: US 6,442,965 B1
(45) Date of Patent: Sep. 3, 2002

(54) DEHYDRATING ACCUMULATOR FOR REFRIGERATION SYSTEMS

(75) Inventor: Maurizio Paesante, Mortara (IT)

(73) Assignee: TI Group Automotive Systems Limited, Abingdon (GB)

( * ) Notice: Subject to any disclaimer, the term of this patent is extended or adjusted under 35 U.S.C. 154(b) by 0 days.

(21) Appl. No.: 09/552,845

(22) Filed: Apr. 20, 2000

(30) Foreign Application Priority Data

Apr. 20, 1999 (IT) ..... M199A0822

(51) Int. Cl.[7] ..... F25B 31/00
(52) U.S. Cl. ..... 62/505
(58) Field of Search ..... 62/503, 498, 174, 62/512

(56) References Cited

U.S. PATENT DOCUMENTS 4,270,934 A * 6/1981 Widdowson et al. ..... 96/152
4,474,035 A * 10/1984 Amin et al. ..... 62/503
4,675,971 A 6/1987 Masserang
4,835,986 A * 6/1989 Carlisle, Jr. ..... 62/503
4,994,185 A 2/1991 Cullen et al.
5,048,309 A * 9/1991 Carlisle, Jr. ..... 62/503
5,184,479 A * 2/1993 Koberstein ..... 62/503
5,282,370 A * 2/1994 Kiblawi et al. ..... 62/503
5,419,157 A * 5/1995 Kiblawi et al. ..... 62/503
5,471,854 A * 12/1995 DeNolf ..... 62/474
5,660,058 A 8/1997 Harris et al.
5,701,758 A * 12/1997 Haramoto et al. ..... 62/503
5,827,359 A * 10/1998 Dobson et al. ..... 96/147

FOREIGN PATENT DOCUMENTS

EP 0 825 399 A1 2/1998

* cited by examiner

*Primary Examiner*—Teresa Walberg
*Assistant Examiner*—Daniel Robinson
(74) *Attorney, Agent, or Firm*—Jenner & Block

(57) ABSTRACT

A dehydrating device for refrigerant has an external casing with an input hole and an output hole formed in a first end thereof. The device is provided with a desiccating filter and is arranged with a substantially U-shaped tube. A diffusion device is provided and a first end of the tube is connected to the output hole, a second end of the tube is open and is in juxtaposition with the diffusing device and the diffusing device is located in upper portion of the casing.

16 Claims, 4 Drawing Sheets

DEHYDRATING ACCUMULATOR FOR REFRIGERATION SYSTEMS

BACKGROUND OF THE INVENTION

1. Field of the Invention

The present invention relates to dehydrating accumulators for refrigeration systems and a method of assembling dehydrating accumulators.

2. Description of the Related Art

Accumulators for refrigeration systems and air conditioning systems for the separation of water from refrigerant are known. Known devices perform this separation while allowing lubricating oil, present in the mixture, to continue to circulate.

The term "refrigeration system" is used herein and it should be understood that this term also includes air conditioning systems, heat pumps and other related systems using refrigerant principles.

Known accumulators provide acceptable operation but are complex devices constructed from a substantially large number of parts. This leads to problems during assembly, results in high assembly costs and leads to susceptibilities in terms of individual components being lost etc. Known accumulators have an external casing which houses components and which is closed by means of a cover. It has also been found that there is a tendency for the external cover to be fitted in an unsatisfactory way, such that there is not a perfect seal between the cover and the housing.

It is an object of the present invention to provide an improved dehydrating accumulator for refrigeration systems.

It is also an object of the present invention to provide a design of dehydrating accumulator that facilitates relatively simple and reliable construction.

BRIEF SUMMARY OF THE INVENTION

According to an aspect of the present invention, there is provided a dehydrating device for refrigerant having an external casing with an input hole and an output hole formed in a first end thereof; a desiccating filtering means; a substantially U-shaped tube; and a diffusing means, wherein a first end of said tube is connected to said output hole; a second end of said tube is open and is in juxtaposition with said diffusing means; and said diffusing means is located in an upper portion of said casing.

In a preferred embodiment, an end of said device is sealed closed by a rotational operation.

BEST MODE FOR CARRYING OUT THE INVENTION

Figure 1:
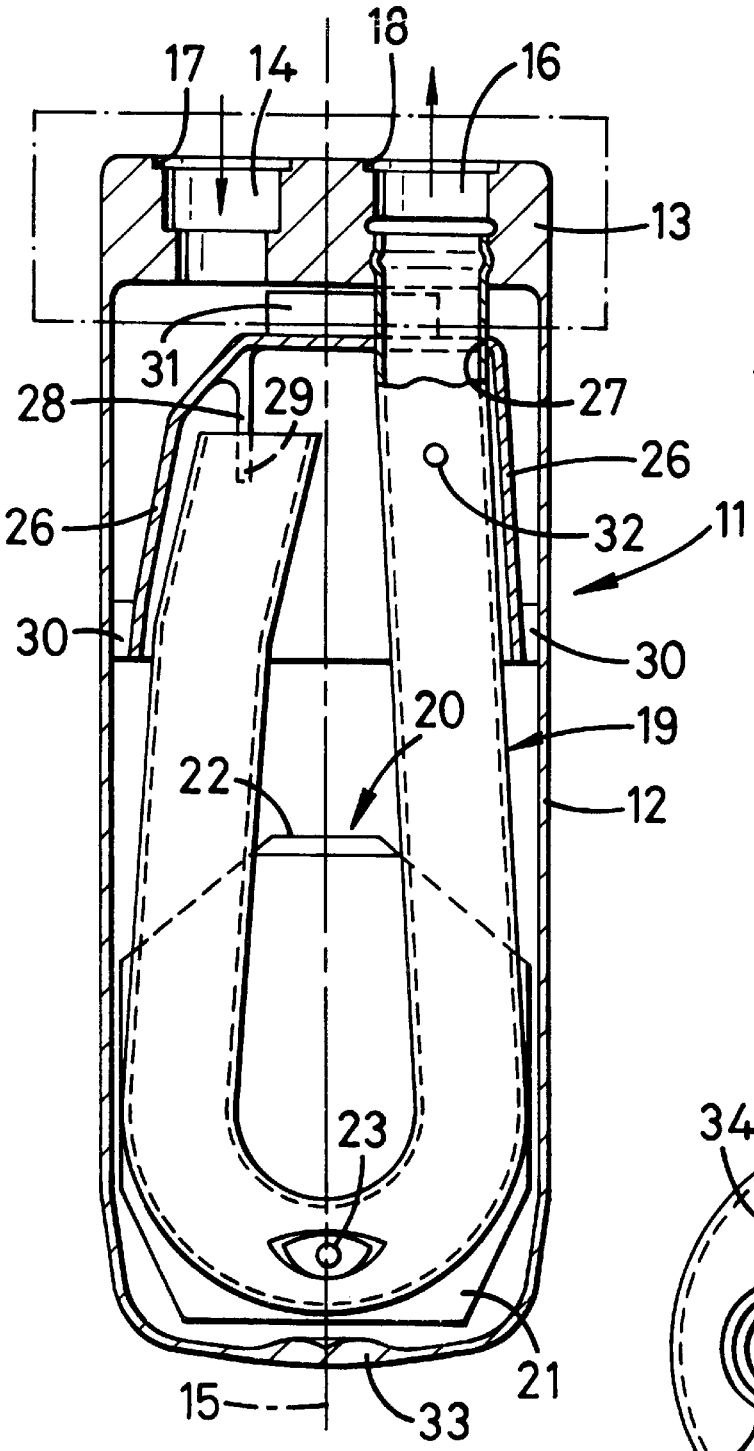
FIG. 1 shows a section of a dehydrating accumulator for refrigeration systems embodying the present invention.

A dehydrating accumulator for a refrigeration system embodying the present invention is illustrated in FIG. 1. The accumulator has a hollow external casing 12 of cylindrical shape, having a base 13 that is relatively thicker than its sides and fabricated in aluminium.

An input hole 14 and an output hole 16 are drilled into the base thereby providing access to and from the accumulator. The holes are equidistant from a parallel axis 15 of the casing 12 and parallel therewith. The external ends of holes 14 and 16 are fitted with moulded connectors 17 and 18 respectively and are configured to accept input and output pipes; not shown in the drawing. An internal end of hole 16 is connected to a tube 19 that is formed into a U-shape and which extends towards an end 33 of the casing whereafter said tube travels back through most of the length of the casing 12. An end of tube 19 is firmly located in output hole 16 and held securely by solder or by an expansion joint.

Before U-shaped tube 19 is fitted, a filter unit 20 is attached thereto, consisting of a pair of polyester bags containing drying material, such as synthetic zeolite pellets. Bags 21, attached at 22 by their two ends, are arranged between the two sides of the U-shaped tube 19 and are mounted astride the lower part of the tube 19 as to almost enclose it. In the lower part of tube 19, in the middle of the U, there is a hole into which a filter 24 is snap fitted, having a projection 25 which passes through the two bags 21, thereby sealing them from each other internally. The filter 24 may be of a plastic construction and is configured to filter out impurities such as dust or other particles present in lubrication oil that has reached the bottom of the casing.

At the upper end of casing 12 there is a diffuser element 26, in the form of an inverted bucket having a hole 27 through which tube 19 can pass, made in this example from polyamide. The diffuser element 26 is designed to provide an optimum distribution of the refrigerant (containing lubricating oil) and to make it relatively turbulent as it enters through the input hole 1.

Within the diffuser element 26, there is a web 28 with lateral wings 29 between which the free end 19A of the tube 19 terminates. At the point of its widest cross section, the diffuser element 26 has centring fins 30 that spread out radially until they reach the internal surface of the casing 12. A hole 32 is provided near to the end of the tube 19 that is located firmly within the output hole 16 to draw off excess oil.

The end of the external cylindrical casing that was originally open, is sealed by applying a rotating process to this end. The operation is carried out by a suitable machine with a wheel that permanently deforms the material of the external cylindrical casing 12, pressing it towards the centre and creating a rounded end which is securely closed and sealed. The base 13 of the external cylindrical casing has threaded holes 34, in addition to input and output holes 14/16, for the location of fixing bolts. In addition, two further small holes 35 are provided to receive centring dowels.

Figure 2:
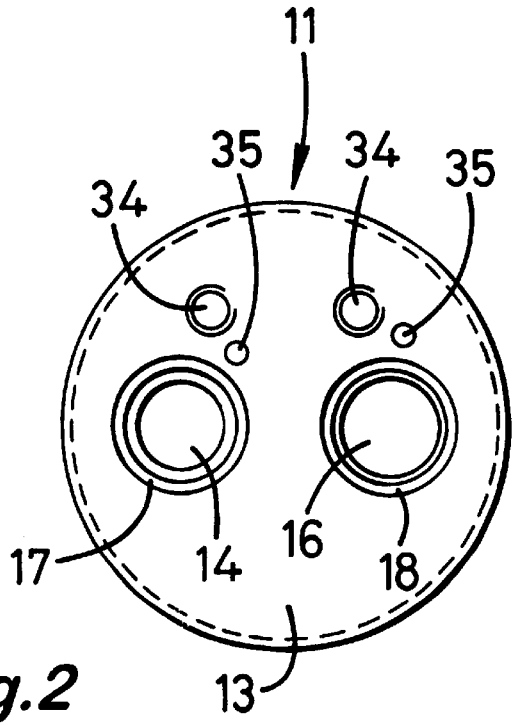
FIG. 2 shows a plan view of the accumulator identified in FIG. 1.
Figure 3:
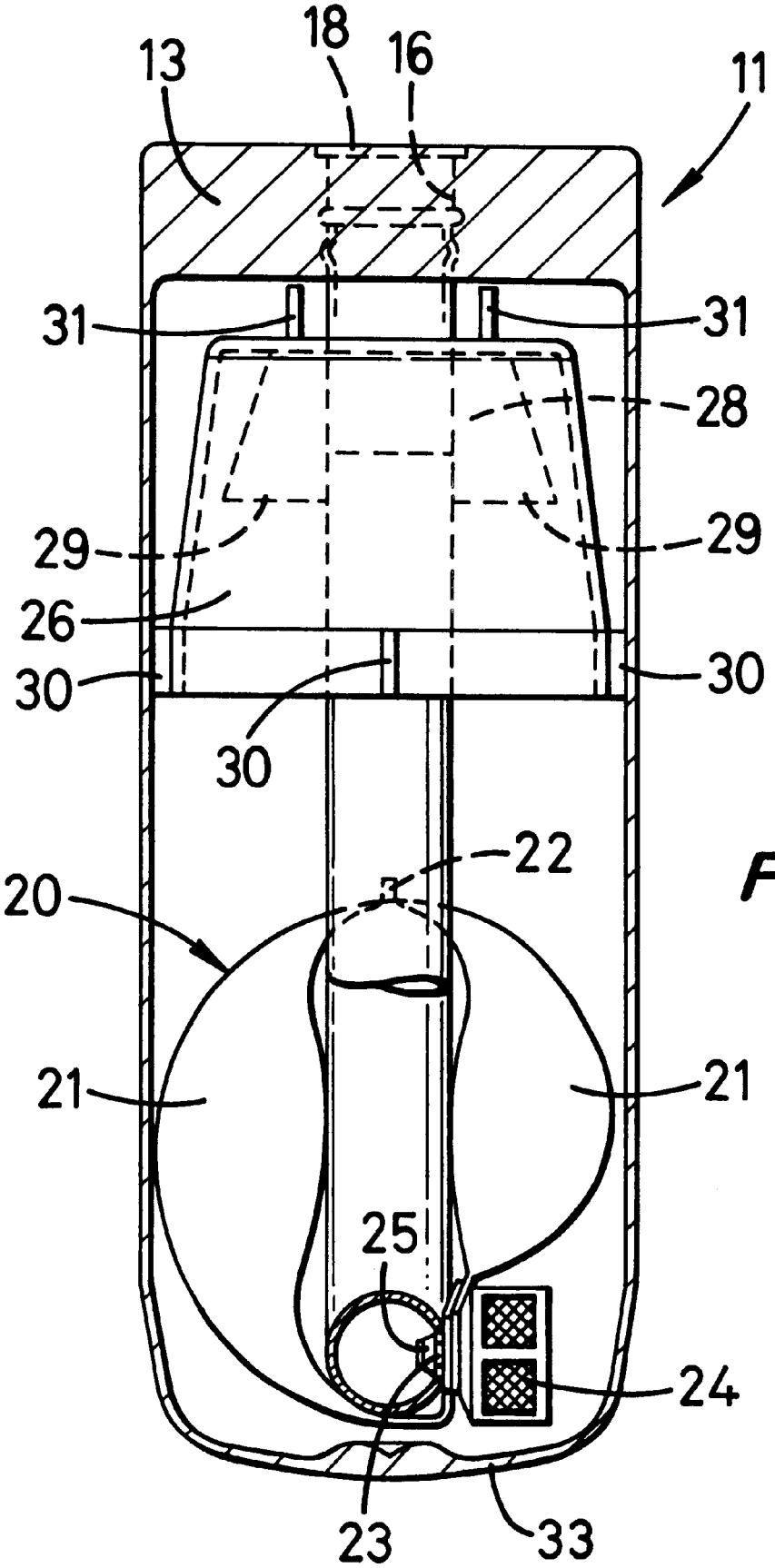
FIG. 3 shows a section through the accumulator rotated by ninety degrees relative to the accumulator shown in FIG. 1.
Figure 4:
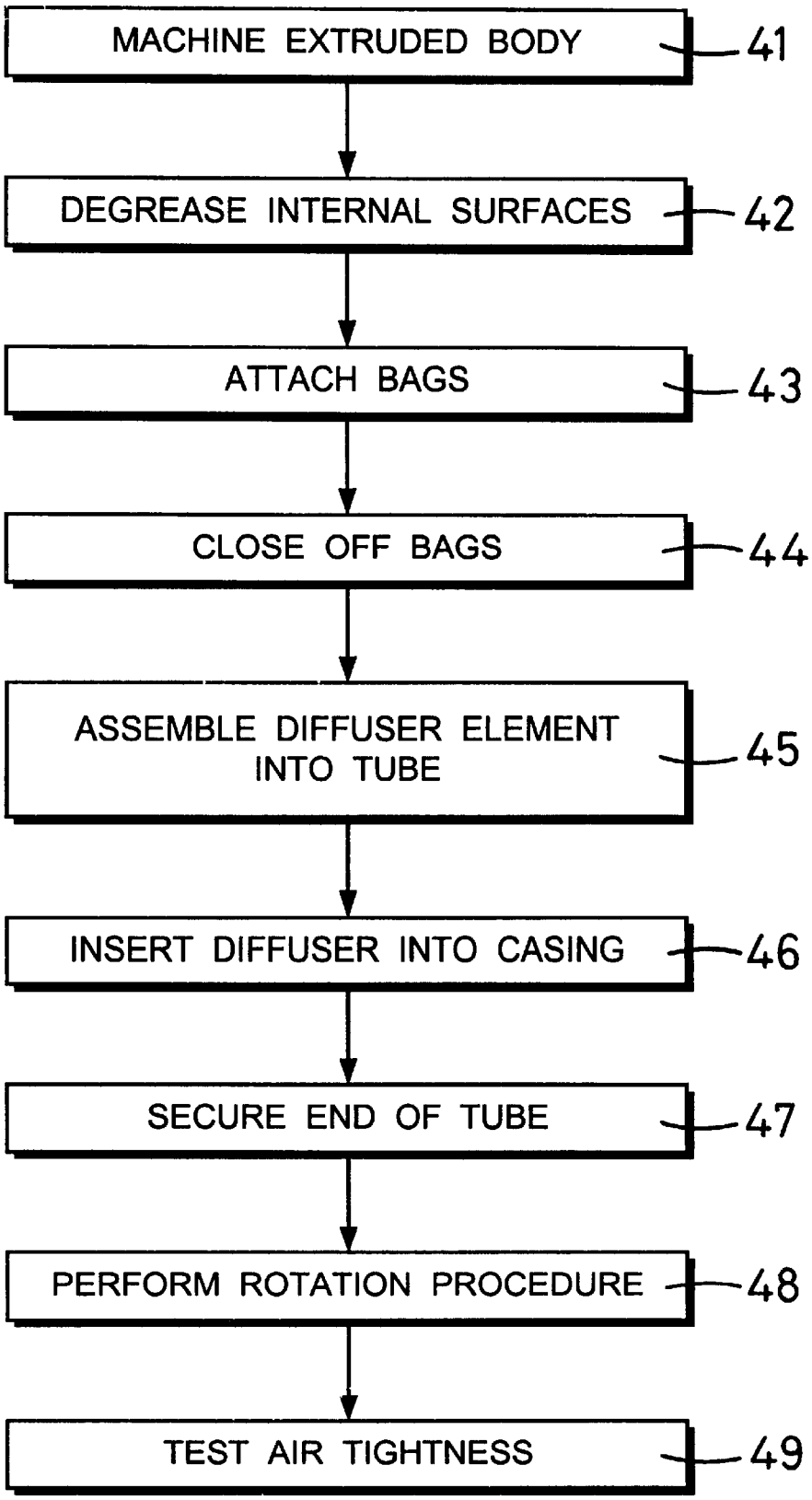
FIG. 4 illustrates the assembly of an accumulator of the type shown in FIG. 1.

A procedure for the construction and assembly of the dehydrating accumulator illustrated in FIGS. 1 to 3, is shown in FIG. 4.

After components making up the accumulator have been prepared, the base of the extruded body is machined at step 41 to obtain holes 14, 16, 34 and 35.

At step 42, all the internal surfaces of the casing 12 are degreased, including the base 13.

At step 43, bags 21 are firmly attached to the tube 19 by means of their two ends that are soldered at position 22.

At step 44, the bags 21 on the tube 19 are closed off by locating filter 24 or its projection 25 in hole 23. The projection also passes through the two bags 21, thereby sealing them from each other.

At step 45, the diffuser element 26 is assembled onto the tube 19, facilitated by the presence of webbing 28, with lateral wings 29 being at a position at which the free end 19A of the tube 19 terminates.

At step 46, diffuser element 26 is inserted into the casing and is guided by centring fins 30 which spread outwards radially. The diffuser element 26 is aligned against the base 13 by means of the further distance pieces 31 designed for this purpose.

At step 47, the end of the tube 19 is secured in the output hole 16 or in the base 13 of the casing 12 by means of an expansion or soldered joint. With the components fitted into the casing, the casing is closed.

At step 48, the closed assembly is secured into the chuck of a lathe or similar machine so as to perform the rotation procedure upon the end of the casing 12. A rounded end 33 is thereby created so as to provide a tight seal.

At step 49, a final step is performed in which an air-tightness test is carried out.

The fully assembled dehydrating accumulator is fully sealed from the outside and contains a minimum number of component parts. By performing the rotational operation, the end cover and the components used to join the end cover have been eliminated.

Figure 5:
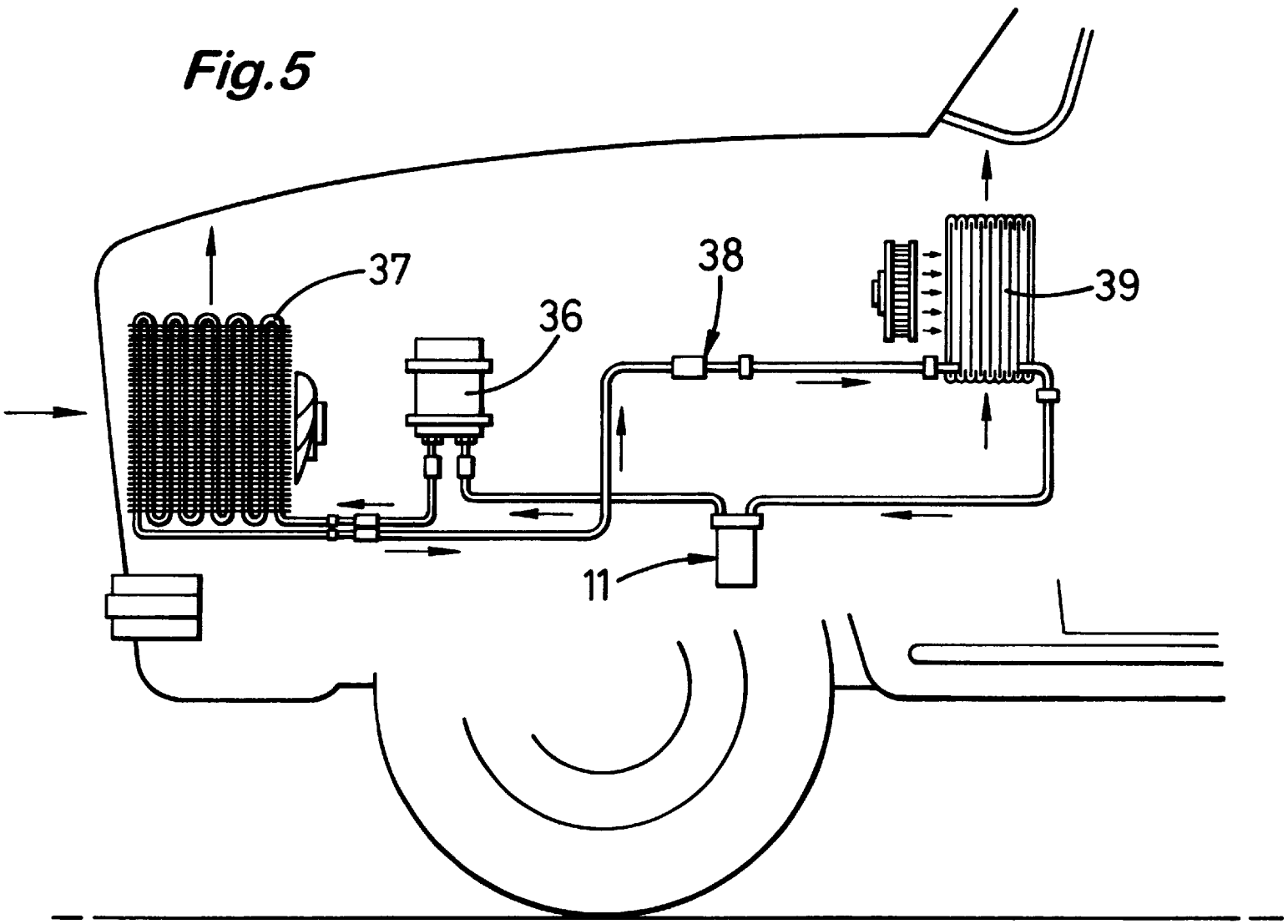
FIG. 5 is a schematic representation of a system using an accumulator of the type shown in FIG. 1.

An example of a dehydrating accumulator for a refrigeration system is illustrated in FIG. 5. An accumulator 11 is fitted into an air conditioning system of a motor vehicle. The system also includes compressor 36, a condenser 37, an expansion unit 38 and evaporator 39. In this system, refrigeration liquid is circulated mixed with oil and the dehydrating accumulator is located in a low pressure part of the system.

What is claimed is:

1. A dehydrating device for refrigerant, having:

an external casing comprising a base end and an opposing end, with an input hole and an output hole formed in said base end;

a desiccating filtering means;

a substantially U-shaped tube; and a diffusing means located within said casing, wherein a first end of said tube is connected to said output hole;

a second end of said tube is open and is in juxtaposition with said diffusing means; and said opposing end of said casing is sealed closed by deforming the material of said casing by a rotational deformation process.

2. A dehydrating device according to claim 1, wherein said filtering unit includes bags containing desiccating material.

3. A dehydrating device according to claim 2, wherein said bags are fixed to said tube at its lower end.

4. A device according to claim 3, wherein said tube has a hole into which is fitted a filter with an extension passing through said bags thereby sealing them from each other.

5. A dehydrating device according to claim 1, wherein the diffusing means is formed substantially like an inverted bucket and has a hole for said tube to pass through.

6. A dehydrating device according to claim 1, in which the diffusing means there is a web with lateral wings within which a free end of said tube is terminated.

7. A dehydrating device according to claim 1, in which said diffusing means has central fins spreading outwards until said fins reach the inside of said casing.

8. A dehydrating device according to claim 1, wherein said input hole and said output hole are positioned parallel to an axis of the casing.

9. A dehydrating device according to claim 1, wherein said base end is thick relative to the sides of the hollow casing and said base end has threaded holes, in addition to said input hole and said output hole, said threaded holes being for the location of fixing bolts.

10. A dehydrating device according to claim 1, wherein said base end is thick relative to the sides of the hollow casing and said base end has holes for receiving centring dowels.

11. A method of fitting a dehydrating device, comprising the steps of obtaining a hollow external casing and the component part of an accumulator;

forming at least one input hole and one output hole in the base of said casing;

performing a degreasing stage;

mounting bags onto the tube by soldering their ends;

mounting a filter in a central section of the tube which closes off the other two ends of the bags;

mounting the diffuser element onto the tube;

mounting an assembly made up of the tube, the bags, the filter and the diffuser element into the external casing;

retaining this assembly within the casing and carrying out a rotational deformation process on the material of the casing, at its open end, so as to create a rounded end forming a tight seal; and performing an air-tightness test.

12. A method according to claim 11, wherein the location of the diffuser element over the tube is due to the presence of a web with lateral fixing wings.

13. A method according to claim 11, wherein the filter is mounted in a central section of the tube by means of inserting its projection into a hole in the tube passing through said bags.

14. A method of manufacturing a dehydrating device for refrigerant, comprising the steps of:

obtaining a hollow external casing having a closed base end and an open opposing end, forming an input hole and an output hole in said base end;

locating a diffusing means, a desiccating means, a filtering means and a substantially U-shaped tube within said hollow casing such that a first end of said tube is connected to said output hole and the second end of said tube is open and is in juxtaposition with said diffusing means; and closing and sealing said opposing end of said hollow casing by deforming the material of said hollow casing by a rotational deformation process.

15. A method of manufacturing a dehydrating device for refrigerant according to claim 14, wherein said U-shaped tube has a hole, said desiccating means comprises bags containing desiccating material, and said filtering means comprises a filtering unit having a projection, said method further comprising the step of passing the projection through said bags and into said hole.

16. A method manufacturing a dehydrating device for refrigerant according to claim 14, wherein said device comprises an extruded body and the base of said extruded body is machined to obtain said input hole and said output hole.

* * * * *